US006891510B2

(12) United States Patent
Le Bolzer et al.

(10) Patent No.: US 6,891,510 B2
(45) Date of Patent: May 10, 2005

(54) DEVICE FOR RECEIVING AND/OR EMITTING SIGNALS WITH RADIATION DIVERSITY

(75) Inventors: Françoise Le Bolzer, Rennes (FR); Ali Louzir, Rennes (FR); Franck Thudor, Rennes (FR); Philippe Minard, Rennes (FR)

(73) Assignee: Thomson Licensing S.A., Boulogne-Billancourt (FR)

( * ) Notice: Subject to any disclaimer, the term of this patent is extended or adjusted under 35 U.S.C. 154(b) by 187 days.

(21) Appl. No.: 10/213,976

(22) Filed: Aug. 7, 2002

(65) Prior Publication Data

US 2003/0034929 A1 Feb. 20, 2003

(30) Foreign Application Priority Data

Aug. 10, 2001 (FR) ..... 01 10696

(51) Int. Cl.[7] ..... H01Q 13/10
(52) U.S. Cl. ..... 343/767; 343/770; 343/700 MS
(58) Field of Search ..... 343/767, 768, 343/769, 770, 700 MS, 725, 728, 729

(56) References Cited

U.S. PATENT DOCUMENTS 4,587,525 A 5/1986 Parsons et al. ..... 343/821
4,719,470 A 1/1988 Munson ..... 343/700
5,193,218 A 3/1993 Shimo ..... 455/80
6,246,377 B1 6/2001 Aiello et al. ..... 343/770
2003/0011520 A1 * 1/2003 Lee ..... 343/700 MS

FOREIGN PATENT DOCUMENTS

EP 0707 357 4/1996
FR 2 785 476 5/2000

* cited by examiner

*Primary Examiner*—Tuyet T. Vo
(74) *Attorney, Agent, or Firm*—Joseph S. Tripoli; Kuniyuki Akiyama

(57) ABSTRACT

The present invention relates to a device for receiving and/or emitting signals comprising at least two means for receiving and/or emitting electromagnetic waves of the slot antenna type and means for connecting the said receiving and/or emitting means to means for exploiting the signals, the means for receiving and/or emitting electromagnetic waves being symmetric with respect to a point, and the connection means consisting of supply lines coupled electromagnetically to the slots of the slot antennas, which are connected on one side to a common supply line which is in a plane passing through the point of symmetry, and on the other to an electronic component enabling a short circuit or an open circuit to be simulated at the end of one of the lines and an open circuit or a short circuit to be simulated at the end of the other line.

10 Claims, 4 Drawing Sheets

DEVICE FOR RECEIVING AND/OR EMITTING SIGNALS WITH RADIATION DIVERSITY

BACKGROUND OF THE INVENTION

The present invention relates to a device for receiving and/or emitting electromagnetic signals with radiation diversity, it being possible for the said device to be used in the field of wireless transmissions, especially within the context of transmissions in a closed or semiclosed environment such as domestic environments, gymnasia, television studios, theatres or the like.

In the known high-speed wireless transmission systems, the signals transmitted by the emitter reach the receiver along a plurality of paths. When they are combined at the receiver, the phase differences between the different rays that have travelled paths of different lengths give rise to an interference pattern capable of causing significant signal fading or detorioration.

Furthermore, the location of the fading changes over time, depending on modifications to the environment such as the presence of new objects or the movement of people. The fading due to the multiple paths may lead to significant detorioration both in the quality of the signal received and in system performance. To combat these fading phenomena, the technique most often used is a technique implementing spatial diversity.

As shown in FIG. 1, this technique consists, inter alia, in using a pair of antenna with wide spatial coverage such as two antennas 1, 2 of the slot type which are connected by supply lines 4, 5 to a switch 3. The two antennas 1, 2 consisting of annular slots are separated by a distance which must be greater than or equal to $\lambda_0/2$ where $\lambda_0$ is the wavelength in a vacuum corresponding to the operating frequency of the antenna. Furthermore, the supply lines 4, 5 are dimensioned such that they cut the slot of the slot antenna at a length $k\lambda_m/4$ from its end and that they are connected to the switch 3 by a length of line equal to $k'\lambda_m/2$ where $\lambda_m$ is the wavelength guided by the line at the central operating frequency with $\lambda_m=\lambda_0/\sqrt{\epsilon_{reff}}$ where $\lambda_0$ is the wavelength in a vacuum and $\epsilon_{reff}$ is the effective permittivity of the line, k and k' being integers and k an odd integer.

Slot-type antennas may also be replaced by patch-type antennas. With this type of device, it is possible to demonstrate that the probability of the two antennas simultaneously fading is very small. The demonstration results in particular from the description given in "Wireless digital communications" by Dr Kamilo Feher, chapter 7: "Diversity techniques for mobile wireless radio systems". It is also possible to demonstrate it by means of a pure probability calculation on the assumption that the levels received by each antenna are completely independent. By virtue of the switch 3, it is possible to select the branch connected to the antenna having the highest level by examining the signal received by means of a control circuit (not shown). In fact, since the two antennas 1, 2 are sufficiently separated, two uncorrelated channel responses are obtained. It is thus possible to switch to the better of the two antennas and thus reduce considerably the probability of fading.

BRIEF SUMMARY OF THE INVENTION

The aim of the present invention is to provide an alternative solution to the conventional solutions using spatial diversity such as the solution described above.

The subject of the present invention is therefore a device for receiving and/or emitting signals comprising at least two means for receiving and/or emitting electromagnetic waves of the slot antenna type and means for connecting the said receiving and/or emitting means to means for exploiting the signals, characterized in that:

the means for receiving and/or emitting electromagnetic waves are symmetric with respect to a point, and in that the connection means consist of supply lines coupled electromagnetically to the slots of the slot antennas, which are connected on one side to a common supply line which is in a plane passing through the point of symmetry, and on the other to an electronic component enabling a short circuit or an open circuit to be simulated at the end of one of the lines and an open circuit or a short circuit to be simulated at the end of the other line.

The solution described above provides a new antenna topology operating according to the principle of radiation diversity. It is based on switching omnidirectional radiating elements placed close to each other.

According to one embodiment, the means for receiving and/or emitting electromagnetic waves of the slot antenna type consist of resonant slots produced by printed or coplanar technology. The slots have an annular, square or rectangular shape or are formed by dipoles. According to a variant, the slots are fitted with means enabling a circularly polarized wave to be radiated.

Furthermore, according to the present invention, if the electronic component providing the switching is perfect, that is if it has a perfect short circuit and open circuit, the length of the supply line between the electronic component and the slot coupled electromagnetically to the said line is equal to the central operating frequency, at $k\lambda_m/4$ where $\lambda_m=\lambda_0/\sqrt{\epsilon_{reff}}$ and where $\lambda_0$ is the wavelength in a vacuum, $\epsilon_{reff}$ is the effective permittivity of the line and k is an odd integer. If the electronic component is not perfect, the line length must be matched to take account of the parasitic elements.

According to a preferred embodiment, the electronic component consists of a diode, an electronic switch, a transistor or any switching circuit such as a microelectromechanical system known as a "Micro-ElectroMechanical System" or MEM.

DESCRIPTION OF PREFERRED EMBODIMENTS

Other characteristics and advantages of the present invention will become apparent on reading the description of various embodiments, this description being made with reference to the appended drawings in which.

Figure 3:
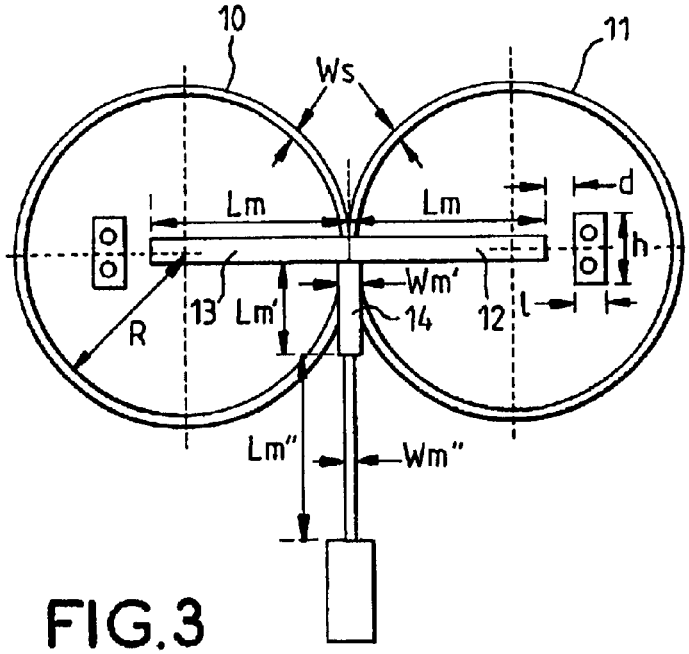
FIG. 3 is a top plan view of the mockup used to simulate a device according to FIG. 2.
Figure 3A:
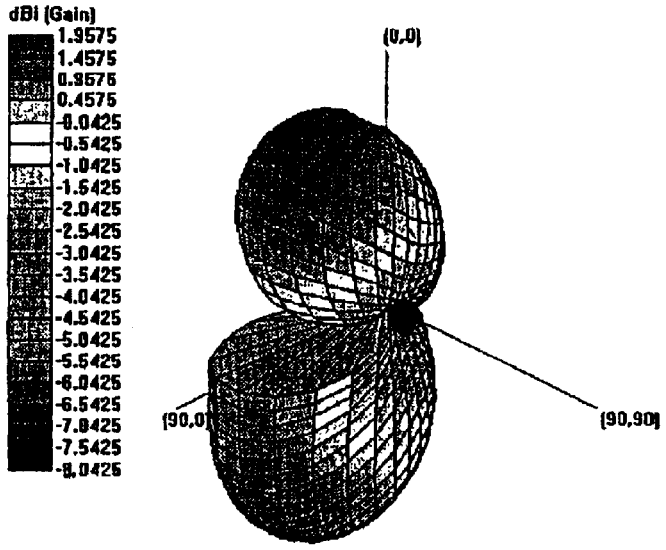
Figure 3B:
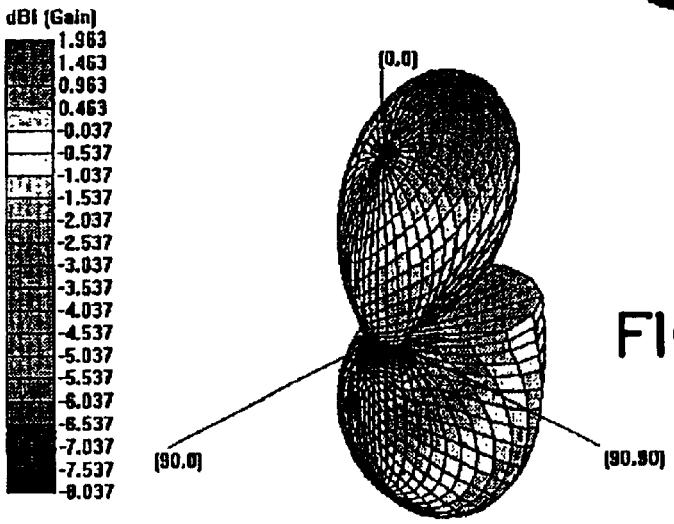
Figure 3C:
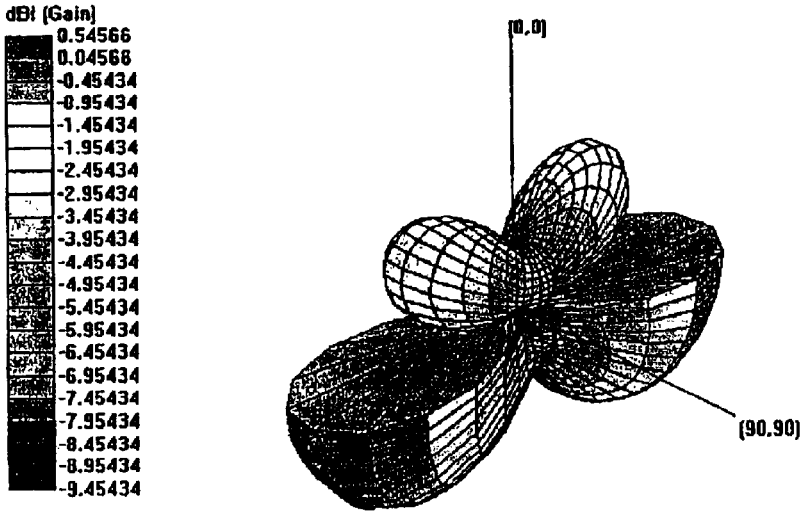

FIGS. 3*a*, 3*b* and 3*c* show the radiation of the device of FIG. 3 according to three antenna operating states.

Figure 4:
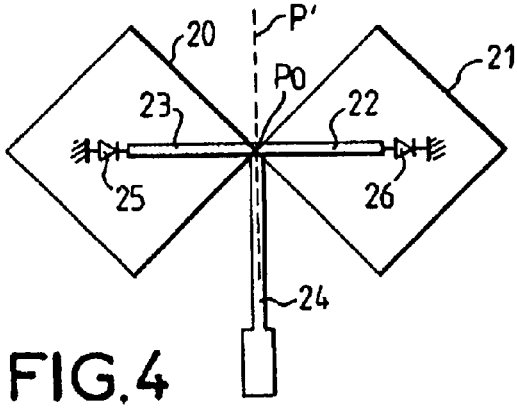

FIG. 4 shows a schematic plan view of another embodiment of an emitting/receiving device according to the present invention.

Figure 5:
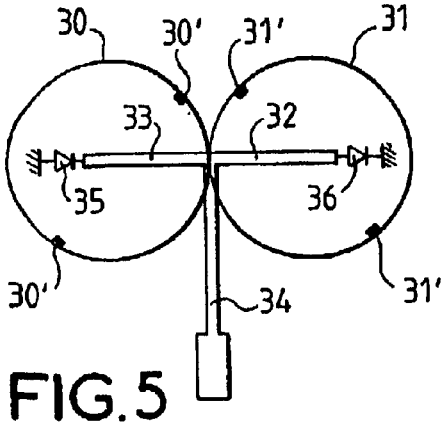
Figure 6:
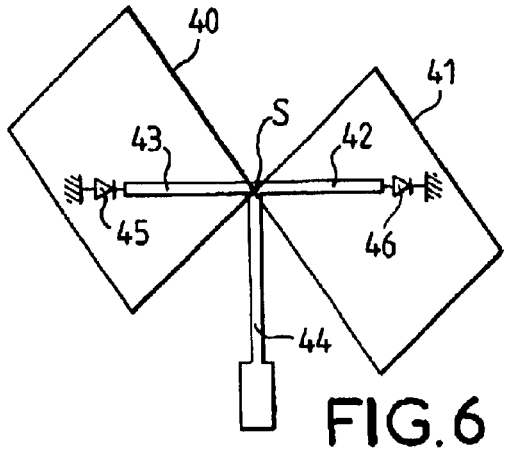

FIGS. 5 and 6 show two schematic variants in plan allowing operation with circular polarization.

Figure 7:
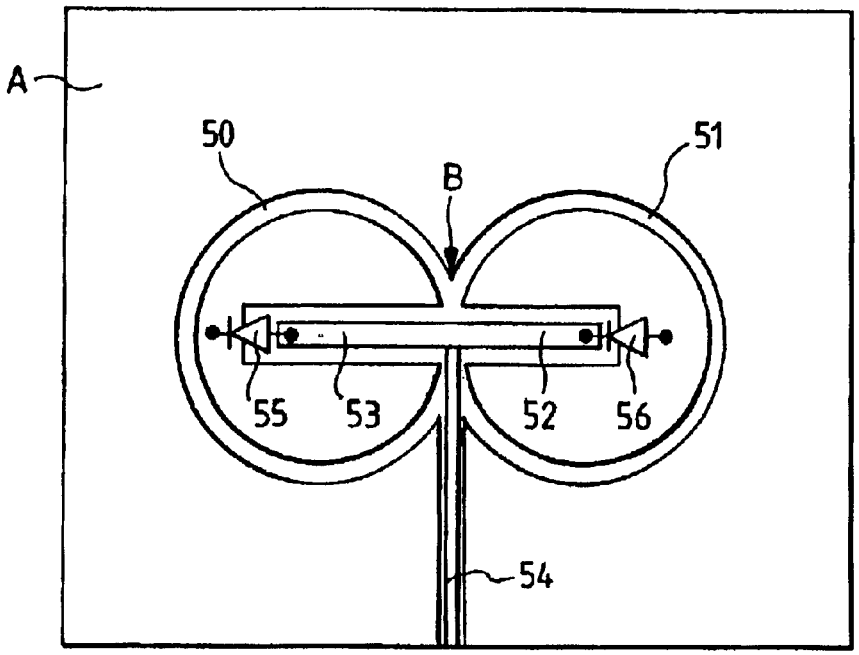

FIG. 7 shows a schematic plan view of another embodiment of an emitting/receiving device according to the present invention using coplanar technology.

Figure 8:
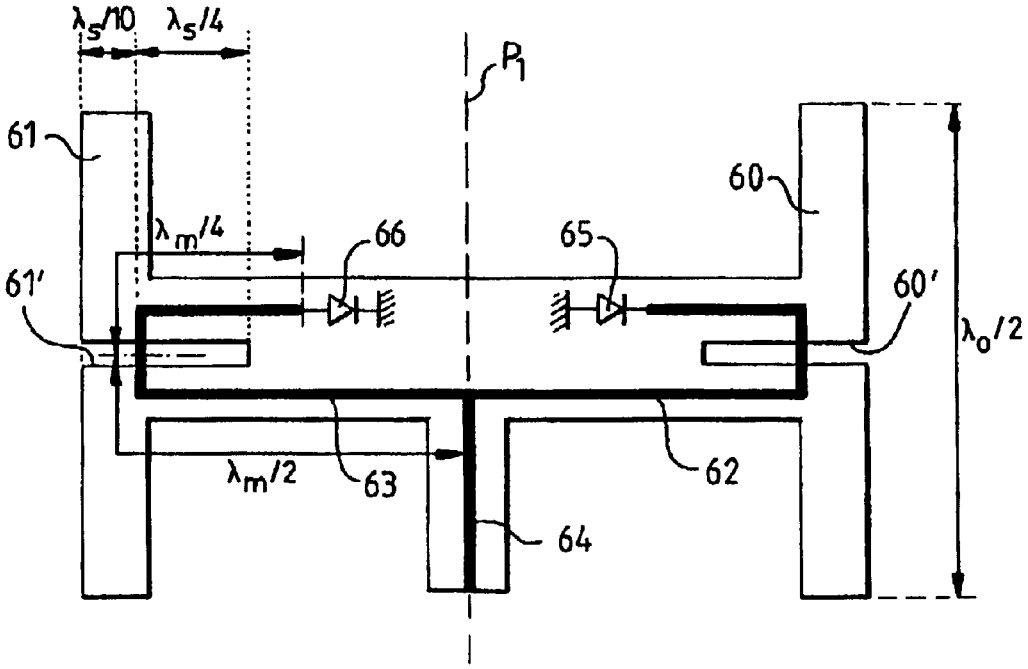

FIG. 8 shows a plan view of yet another embodiment of an emitting/receiving device according to the present invention.

DESCRIPTION OF PREFERRED EMBODIMENTS

A first embodiment for receiving and/or emitting electromagnetic signals with radiation diversity according to the present invention will first of all be described.

Figure 1:
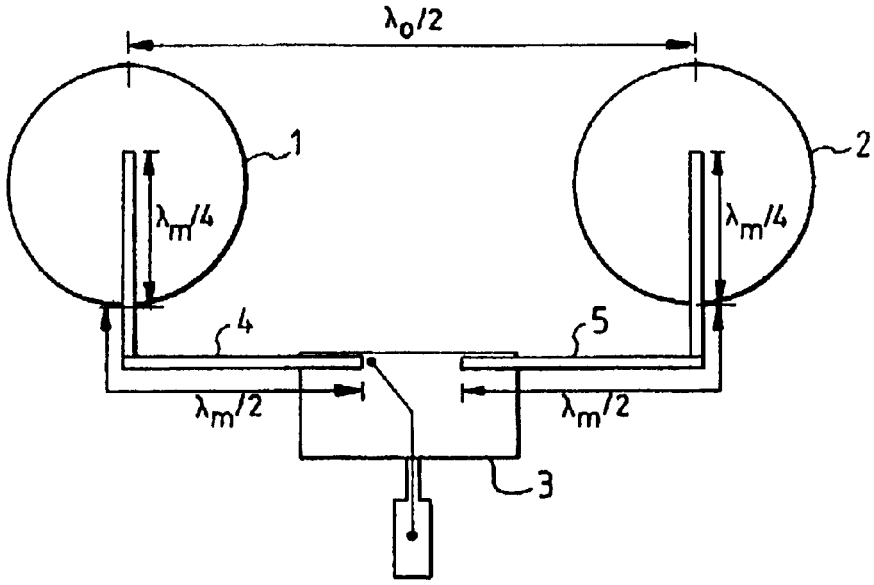
FIG. 1 (already described) is a schematic plan view of an emitting/receiving device with spatial diversity according to the present invention.
Figure 2:
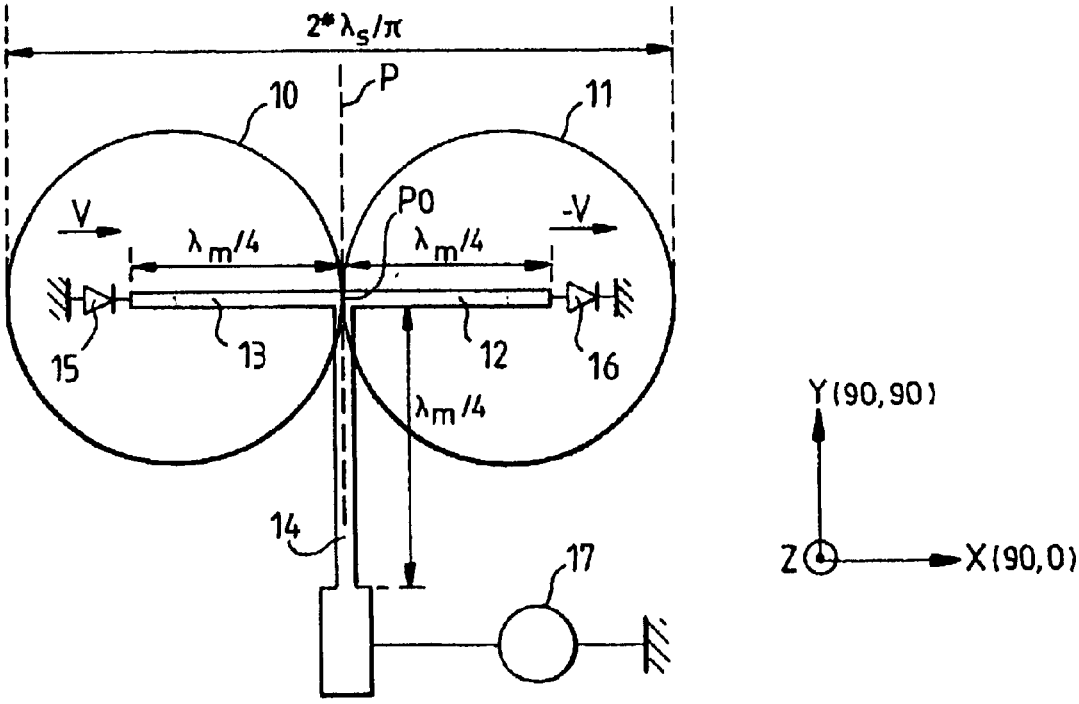
FIG. 2 is a schematic plan view of a first embodiment of an emitting/receiving device according to the present invention.

As shown in FIG. 2, this device for receiving and/or emitting signals, produced by printed technology, consists of two elements of the slot antenna type formed from annular slots 10 and 11, these two slots being symmetrical with respect to a plane P and being cotangent at a point $P_0$ in the embodiment shown.

According to the present invention, in order to achieve radiation diversity, the two annular slots are arranged either so as to overlap, as in the embodiment shown, or so as to be separate but placed very close to each other. Preferably, the extreme length between the two antennas of the slot antenna type is equal to $2 \times \lambda_s/\pi$ where $\lambda_s$ is the wavelength guided in the slot at the operating frequency.

As shown in FIG. 2, the two antennas 10 and 11 of the annular slot type are supplied by supply lines produced by microstrip technology. Conventionally, they are supplied by two microstrip lines 12, 13 dimensioned so as to be equal to $k\lambda_m/4$ where $\lambda_m=\lambda_0/\sqrt{\epsilon_{reff}}$ with $\epsilon_0$ the wavelength in a vacuum at the central operating frequency, $\epsilon_{reff}$ the effective permittivity of the line and k an odd integer. The two microstrip lines 12, 13 are located on either side of the contact plane P of the two slots 10, 11 and extend towards the inside of the slots. They are supplied by a common line 14 whose dimensions are defined so as to match the structure. The supply line 14 is centered on the plane P and arranged perpendicular to the lines 12, 13. The supply line 14 is connected at its other end to means for supplying and exploiting the signals symbolized by the element 17. These means consist in a known manner of emitting and receiving means.

According to the present invention, and as shown in FIG. 2, the microstrip line/slot coupling is controlled by diodes 15, 16 connected in a particular way at the ends of the two supply lines 12, 13. Thus the diode 15 is connected in reverse bias between the end of the supply line 13 and earth, while the diode 16 is connected in forward bias between the end of the supply line and earth. This particular type of diode connection makes it possible to obtain, assuming that the two diodes 15 and 16 are identical and have a bias voltage V1 greater than 0, three operating states for the device depending on the bias voltage provided by the supply line 14.

State 1: if the bias voltage v is chosen such that v>V1, in this case, the diode 15 is on while the diode 16 is off. As a result, the annular slot 11 is excited in a favoured manner while the annular slot 10 acts more as a reflector.

In this case, a radiation pattern as shown in FIG. 3*a* is obtained. It is inclined away from the annular slot 11.

State 2: the bias voltage v is such that v<V1. In this case, the diode 15 is off while the diode 16 is on. A situation symmetric with state 1 is obtained. As a result, the annular slot 10 is excited while the annular slot 11 acts as a reflector. A radiation pattern as shown in FIG. 3*b* is therefore obtained which is inclined away from the slot 10.

State 3: the bias voltage is equal to 0. In this case, the two diodes 15 and 16 are off, the two annular slots 10, 11 are simultaneously excited, with parallel electric fields in opposite senses. The resulting radiation pattern is that shown in FIG. 3*c*.

The radiation patterns of FIGS. 3*a* and 3*b* have been obtained by means of a mockup as shown in FIG. 3. This mockup shows an emitting and/or receiving device of the type shown in FIG. 2. It comprises two annular slots 10, 11 which are cotangent at $P_0$. The annular slots have a radius R=6.5 mm and a width Ws=0.4 mm. They are supplied by two identical supply lines 12, 13 having a length Lm=5.75 mm and width 0.3 mm. They are connected at the point $P_0$ to a supply line 14 having a length Lm'=3.6 mm and a width Wm'=0.3 mm followed by a matching length Lm''=7.5 mm with a width Wm'=0.25 mm. The diodes 15, 16 are connected to earth by two plated-through holes of radius r=0.4 mm, placed near the line on a metallic rectangular base of dimensions h=3 mm and D=1.5 mm. The tests carried out on this mockup cause radiation diversity to appear, as mentioned above.

Thus, with a device as shown in FIG. 2, it is possible to switch between three substantially different radiation patterns. An antenna with order 3 radiation diversity is therefore obtained, thus significantly improving the quality of the wireless connection.

This solution provides an antenna of low overall size requiring only the use of two diodes or similar switching elements such as MEMs for controlling the pattern.

Various embodiments of a device according to the present invention, made using printed technology, will now be described with reference to FIGS. 4 to 6. Thus, as shown in FIG. 4, the emitting/receiving means of the slot antenna type consist of two square slots 20, 21 which are symmetrical with respect to a point $P_0$.

According to the present invention, the two antennas 20, 21 are supplied by two supply lines 22, 23 starting at the point $P_0$ and going towards the inside of the antenna consisting of a square-shaped slot and having, in a known manner, a length equal to $k\lambda_m/4$ where $\lambda_m=\lambda_0/\sqrt{\epsilon_{reff}}$ with $\epsilon_0$ the wavelength in a vacuum at the central operating frequency, $\epsilon_{reff}$ the effective permittivity of the line and k an odd integer.

A diode 25, 26, mounted in an identical manner to the embodiment of FIG. 2, is provided at the end of each supply line 23, 22 respectively. That is, the diode 25 is mounted in reverse bias between the end of the line 23 and earth, while the diode 26 is mounted in forward bias between the end of the line 22 and earth. The two supply lines 22, 23 are connected to a common supply line 24 at the point $P_0$. The supply line 24 perpendicular to the two supply line 23, 22 is in the plane of symmetry P' and has dimensions matching the emitting/receiving circuit (not shown).

Two other embodiments of the emitting/receiving devices according to the present invention will now be described with reference to FIGS. 5 and 6.

In this case, the antennas of the slot antenna type allow a circularly polarized wave to be radiated. In the embodiment of FIG. 5, the antennas consist of annular slots 30, 31 which are symmetrical with respect to a plane passing through the point of contact. In a known manner, in order to produce circular polarization, the slots 30, 31 are fitted with diagonally opposed notches 30', 31'.

According to the present invention, the antennas 30, 31 are supplied by supply line 32, 33, 34 having the same characteristics as the supply lines 12, 13, 14 of FIG. 2. Furthermore, the supply lines 32, 33 are connected to diodes 36, 35 mounted between the end of the supply line and earth, in the same way as the diodes 15, 16 in the embodiment of FIG. 2. Consequently, operation of the device of FIG. 5 will be identical to the operation of the device of FIG. 2 and three states will be obtained depending on the bias voltage applied to the diodes.

FIG. 6 shows another embodiment of antennas allowing circular polarization. In this case, the antennas consist of two rectangular slots 40, 41 which are symmetrical with respect to one of their apexes S. According to the present invention, the antennas 40, 41 are supplied by microstrip supply lines 42, 43, 44 as in the embodiment of FIG. 4. Diodes 46, 45 are connected to the ends of supply lines 42, 43, respectively, in the same way as in the embodiment of FIG. 4.

FIG. 7 shows an emitting/receiving device according to the present invention, produced by coplanar technology. In this case, the antennas consist of two antennas 50, 51 produced by coplanar technology. Thus, a metal layer A has been deposited on a substrate, in which layer two annular slots 50, 51 cotangent at the point B have been produced. In this case, the supply lines consist of a coplanar line comprising a line element 52 and a line element 53 each having a length equal to $k\lambda_m/4$ with $\lambda_m$ and k having values identical to those mentioned above, for the case where the switching component is perfect.

According to the present invention, the ends of the two line elements 52, 53 are connected to the earth formed by the metal layer A via specially connected diodes 56, 55. The two coplanar line elements 52, 53 are connected to a perpendicular supply line 54 along a plane passing through the point B, this line itself also being produced by coplanar technology.

Yet another embodiment of the present invention will now be described with reference to FIG. 8. In this case, the two antennas consist of dipoles which are symmetrical with respect to a plane P1. In this case, the two antennas consist of T-shaped dipoles 60, 61, the branches of the T of which have a length close to $\lambda_0/2$ where $\lambda_0$ is the wavelength in a vacuum. Each branch of the T is provided in its middle with a slot 60', 61'. Each dipole is supplied by means of electromagnetic coupling by a supply line 62, 63 produced by printed technology. The supply lines 62 and 63 are both connected to a common supply line 64 which is in the plane of symmetry P1. The supply lines 62, 63 have a length to the slot 60', 61' equal to $\lambda_m/2$, and then extend beyond the slot by a length of the supply line equal to $\lambda_m/4$ where $\lambda_m$ is the wavelength guided in the microstrip line, this in the case where the switching component is perfect.

According to the present invention, diodes 65, 66, connected in a manner which is identical to the other embodiments, are provided at the ends of the two supply lines 62, 63. Thus the diode 65 is connected in reverse bias between the end of the supply line 62 and earth while the diode 66 is connected in forward bias between the end of the supply line 63 and earth.

As shown in the figure, the supply lines 62 and 63 are electromagnetically coupled with the slots 60', 61' at a distance $\lambda_s/4$ from the bottom of the inner end of the said slots. Furthermore, in the embodiment shown, the supply lines 62, 63 are at a distance $\lambda_s/10$ from the end of the dipole.

What is claimed is:

1. Antenna device comprising:

a first electromagnetic waves radiating slot antenna and a second electromagnetic waves radiating slot antenna, said first and second slot antenna being symmetric with respect to a point; and a connection means for connecting said first and second slot antennas to means for exploiting electromagnetic waves, the connection means consisting of a first supply line electromagnetically coupled to the first slot antenna and a second supply line electromagnetically coupled to the second slot antenna, the first and the second supply lines being connected on one side to a common supply line extending in a plane passing through the point of symmetry and on the other side to an electronic component enabling a short circuit or an open circuit to be simulated at the end of the first supply line and an open circuit or a short circuit to be simulated at the end of the second supply line, wherein the first and second slot antennas are fitted with means enabling a circularly polarized wave to be radiated.

2. Antenna device comprising:

a first electromagnetic waves radiating slot antenna and a second electromagnetic waves radiating slot antenna, said first and second slot antenna being symmetric with respect to a point; and a connection means for connecting said first and second slot antennas to means for exploiting electromagnetic waves, the connection means consisting of a first supply line electromagnetically coupled to the first slot antenna and a second supply line electromagnetically coupled to the second slot antenna, the first and the second supply lines being connected on one side to a common supply line extending in a plane passing through the point of symmetry and on the other side to an electronic component enabling a short circuit or an open circuit to be simulated at the end of the first supply line and an open circuit or a short circuit to be simulated at the end of the second supply line, wherein the length of the supply line between the electronic component and the slot coupled electromagnetically to the said line is equal to the central operating frequency, at $k\lambda m/4$ where $\lambda m=\lambda o/\sqrt{\epsilon reff}$ and where $\lambda o$ is the wavelength in a vacuum, $\epsilon reff$ is the effective permittivity of the line and k is an odd integer.

3. Antenna device comprising:

a first electromagnetic waves radiating slot antenna and a second electromagnetic waves radiating slot antenna, said first and second slot antenna being symmetric with respect to a point; and a connection means for connecting said first and second slot antennas to means for exploiting electromagnetic waves, the connection means consisting of a first supply line electromagnetically coupled to the first slot antenna and a second supply line electromagnetically coupled to the second slot antenna, the first and the second supply lines being connected on one side to a common supply line extending in a plane passing through the point of symmetry and on the other side to an electronic component enabling a short circuit or an open circuit to be simulated at the end of the first supply line and an open circuit or a short circuit to be simulated at the end of the second supply line, wherein the supply line is made using microstrip technology or coplanar technology.

4. Antenna device comprising:

a first electromagnetic waves radiating slot antenna and a second electromagnetic waves radiating slot antenna, said first and second slot antenna being symmetric with respect to a point; and a connection means for connecting said first and second slot antennas to means for exploiting electromagnetic waves, the connection means consisting of a first supply line electromagnetically coupled to the first slot antenna and a second supply line electromagnetically coupled to the second slot antenna, the first and the second supply lines being connected on one side to a common supply line extending in a plane passing through the point of symmetry and on the other side to an electronic component enabling a short circuit or an open circuit to be simulated at the end of the first supply line and an open circuit or a short circuit to be simulated at the end of the second supply line.

5. Device according to claim 4, wherein, the first and second electromagnetic waves radiating slot antennas consist of resonant slots produced by printed or coplanar technology.

6. Device according to claim 5, wherein the slots have an annular, square or rectangular shape or are formed by dipoles.

7. Device according to claim 4, wherein the slots are fitted with means enabling a cirularly polarized wave to be radiated.

8. Device according to claim 4, wherein the electronic component consists of a diode, an electronic switch, a transistor or a micro-electromechanical system.

9. Device according to claim 4, wherein the length of the supply line between the electronic component and the slot coupled electromagnetically to the said line is equal to the central operating frequency, at $k\lambda_m/4$ where $\lambda_m=\lambda_0/\sqrt{\epsilon_{reff}}$ and where $\lambda_0$ is the wavelength in a vacuum, $\epsilon_{reff}$ is the effective permittivity of the line and k is an odd integer.

10. Device according to claim 9, wherein the supply line is made using microstrip technology or coplanar technology.

* * * * *